United States Patent [19]

Hinsley et al.

[11] Patent Number: 4,736,664

[45] Date of Patent: Apr. 12, 1988

[54] PIANO PEDAL ACTIVATOR FOR PARAPLEGICS

[76] Inventors: J. D. Hinsley, 505 Old Mill Rd., Salado, Tex. 76571; Bobby Norwood, 2610 Raspberry, Pasadena, Tex. 77502

[21] Appl. No.: 18,400

[22] Filed: Feb. 25, 1987

Related U.S. Application Data

[63] Continuation-in-part of Ser. No. 769,365, Aug. 26, 1985, abandoned.

[51] Int. Cl.[4] ..... G10C 3/26

[52] U.S. Cl. ..... 84/231; 318/266

[58] Field of Search ..... 84/19–23, 84/107, 108, 113, 225, 230, 231, 358; 318/266, 286, 553

[56] References Cited

U.S. PATENT DOCUMENTS

| | | | |
|---|---|---|---|
| 685,546 | 10/1901 | Whitehead | 84/108 |
| 733,702 | 7/1903 | Davis | 84/21 |
| 2,345,594 | 4/1944 | Gardner | 318/266 |
| 2,710,556 | 6/1955 | Koehl | 84/225 X |
| 3,588,652 | 6/1971 | Lewis | 318/286 |
| 4,018,128 | 4/1977 | Megee | 84/231 |
| 4,206,677 | 6/1980 | Ramsey | 84/107 |

*Primary Examiner*—L. T. Hix
*Assistant Examiner*—Brian W. Brown
*Attorney, Agent, or Firm*—Kenneth D. Baugh

[57] ABSTRACT

A piano pedal activator assembly 12 is provided for actuating a sustaining pedal 14 of a piano 10. The piano pedal activator assembly 12 includes a reversible motor 28 including a shaft 30. A control circuit 62 is provided to activate the motor 28 and rotate the shaft 30. A pedal actuating lever 46 is coupled to shaft 30 through a worm gear assembly 32. Upon activation of the motor 28 to rotate the shaft 30 in one direction the worm gear assembly 32 causes the pedal actuating lever 46 to move downwardly to displace the sustaining pedal 14. When the motor 28 is actuated to turn the shaft 30 in the reverse direction the worm gear assembly 32 causes the pedal actuating lever 46 to move upwardly to release the sustaining pedal 14.

5 Claims, 4 Drawing Sheets

PIANO PEDAL ACTIVATOR FOR PARAPLEGICS

CROSS-REFERENCE

This is a continuation-in-part of Ser. No. 769365 filed Aug. 26, 1985, now abandoned.

TECHNICAL FIELD

The invention relates to a piano pedal activator and more particularly to a pedal activator for use by paraplegics or other handicapped persons.

The piano is one of the more popular musical instruments in use today. That popularity extends to use by the handicapped as well. In the past it has been difficult for some handicapped persons to enjoy the full range of this instrument. This is more evident with persons having limited or no use of their lower limbs because the lower limbs are needed to activate the sustaining pedal of the piano. Accordingly there is a need for a device that enables persons with limited use of their lower limbs or no lower limbs at all to remotely control the sustaining pedal of a piano.

BACKGROUND ART

There are a number of different devices that have been employed in the past to enable persons with limited or no use of the lower limbs to activate the sustaining pedal of a piano.

The devices most commonly used in the past have been mechanical in nature. One such device employs a shortened crutch which engages the pedal and is operated by the shoulder movement of the user. However, such an arrangement throws the hands of the user out of position for accurate playing. Another arrangment requires the use of heavy weights suspended over the piano pedal. In this arrangement the weights are released by use of levers, cables and pulleys. Such an arrangement requires that the user posess a reasonable amount of strength in order to activate the pedal.

Still another device for activating the piano pedal includes a specially constructed bench equipped with levers which activate the pedal when the weight of the user's lower body is shifted. Such a device may be practical for persons with no use or limited use of there lower limbs.

DISCLOSURE OF THE INVENTION

A piano pedal activator is provided to be used to actuate the sustaining pedal of a piano. The piano pedal activator includes a motor having a shaft coupled thereto. A motor activating means is provided to activate the motor to rotate the shaft. The piano pedal activator also includes a pedal actuating lever. A means is providing for coupling the pedal actuating lever to the shaft. Additionally the coupling means moves the pedal actuating lever downwardly to displace the sustaining pedal when the shaft rotates in a first direction and moves the pedal actuator lever upwardly to release the pedal when the shaft rotates in the opposite direction.

BRIEF DESCRIPTION OF THE DRAWING

The details of the invention will be described in connection with the accompanying drawing in which:

As illustrated in FIG. 1 a piano 10 is provided having associated therewith a pedal activator assembly 12 in accordance with the principles of this invention for activating the sustaining pedal 14 of the piano. The pedal activator assembly 12 includes a flexible arm assembly generally designated by the numeral 16 which is coupled to the chair 18 of a user such as for example a wheel chair. The flexible arm may be coupled to the chair 18 by a clamp 19.

Figure 1:
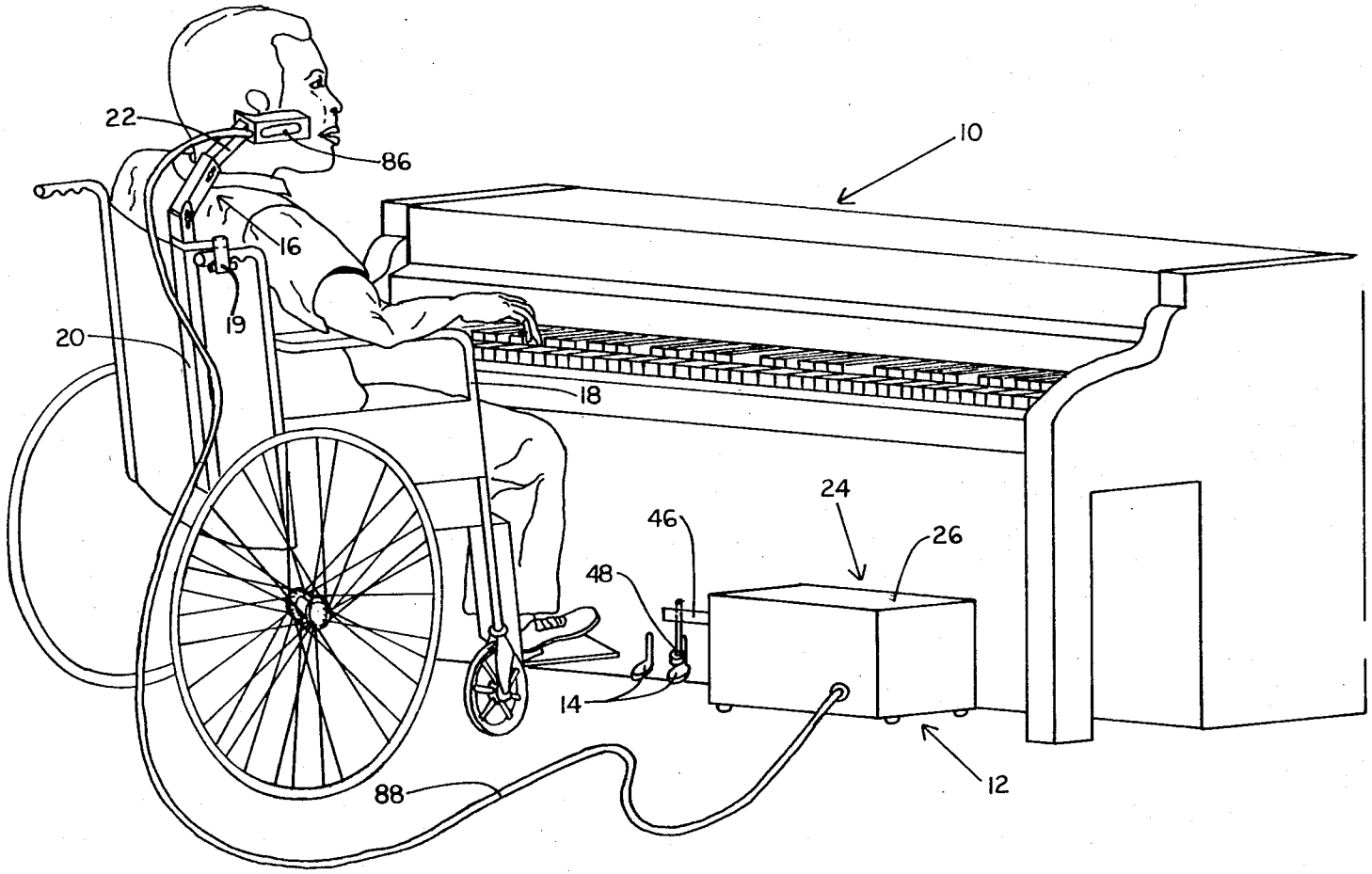
FIG. 1 is a prespective view of a piano pedal activator in accordance with the principles of the invention shown in conjunction with a user and piano.

The flexible arm assembly 16 includes a first portion 20 and a second portion 22 coupled to and extending from the first portion 20.

The pedal activator assembly 12 also includes a power unit generally designated by the numeral 24 enclosed in a cabinet 26.

Figure 2:
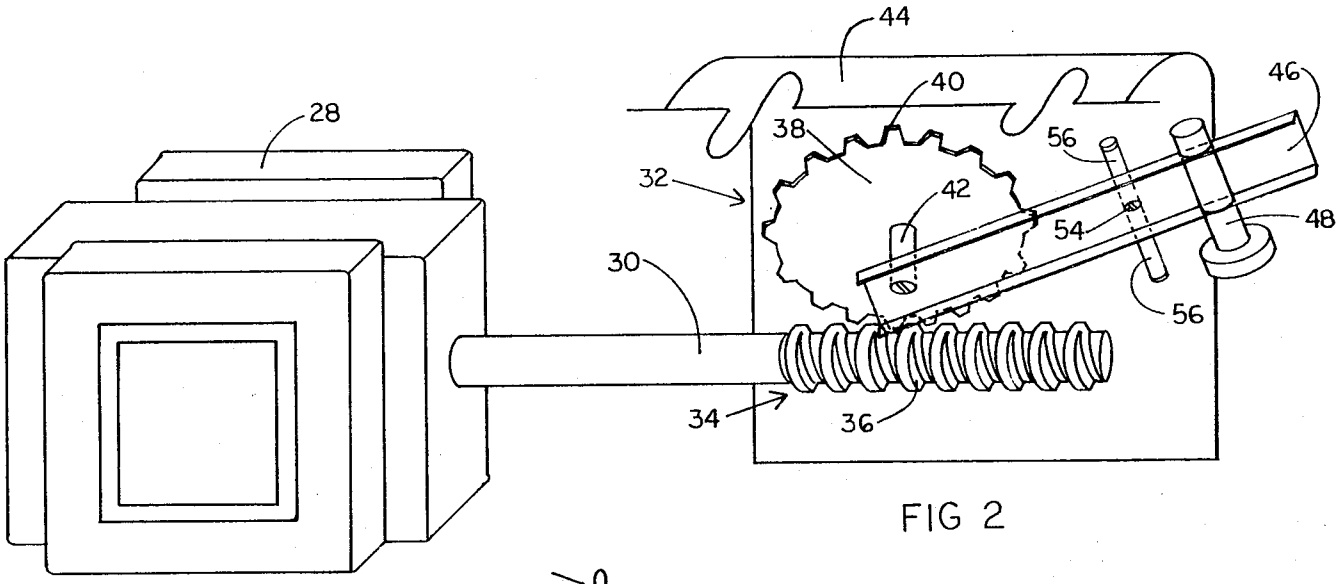
FIG. 2 is an exposed prespective view of portions of the power unit of the piano pedal activator in accordance with the principles of the invention.
Figure 3:
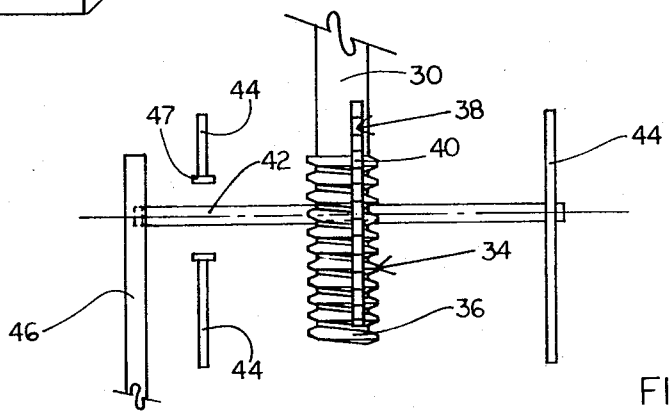
FIG. 3 is a top view of the gear assembly of the power unit of the piano activator in accordance with the principles of the invention.
Figure 4:
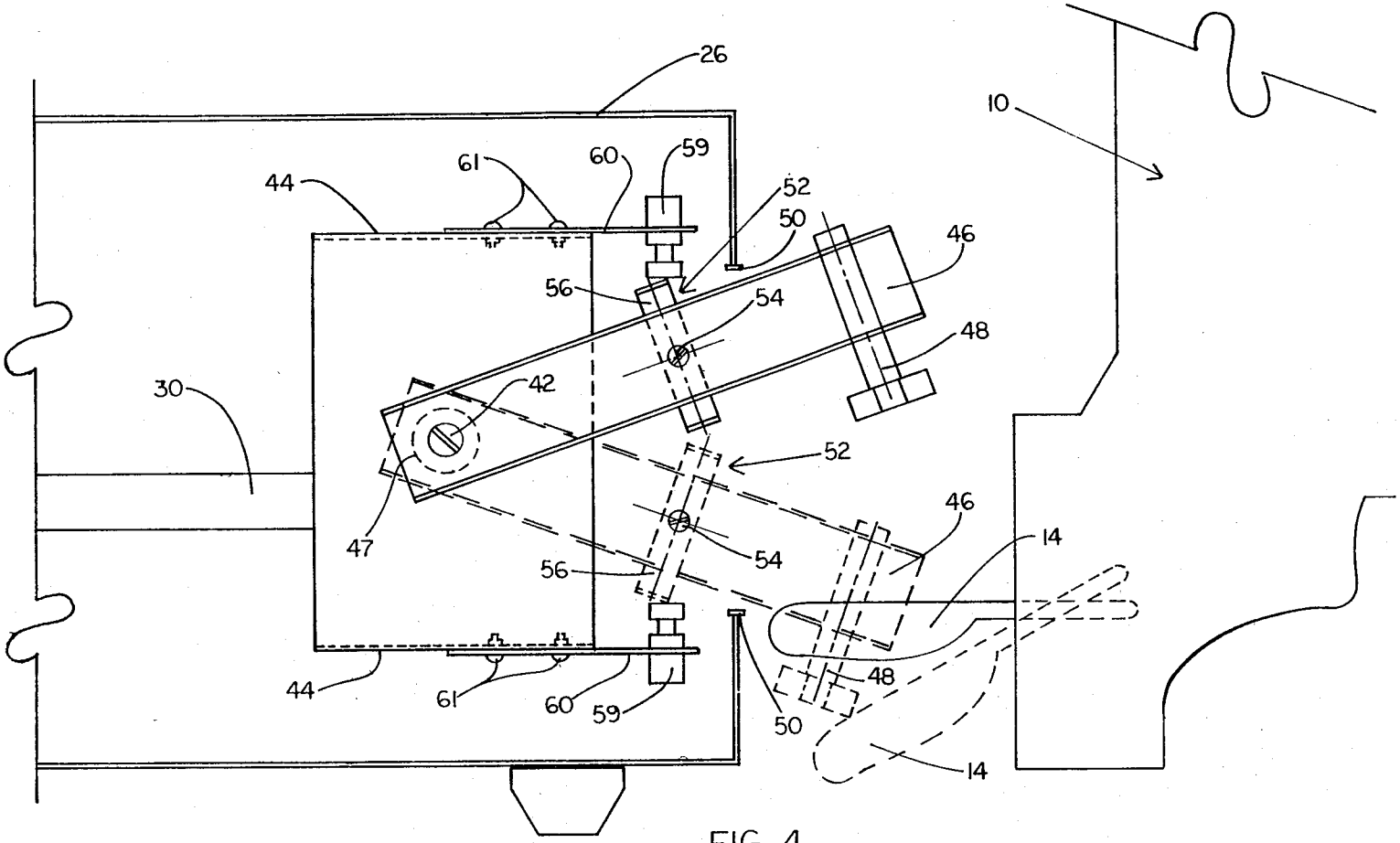
FIG. 4 is an enlarged exposed view of the operation of the actuating lever in accordance with the principles of the invention.

Referring to FIGS. 2, 3, and 4 the power unit 24 is provided with a motor 28 having a shaft 30. The motor 28 maybe for example a reversible 12 volt D.C. motor.

The motor 28 is coupled through the shaft 30 to a worm drive assembly generally designated by the numeral 32. The worm drive assembly 32 includes a worm gear 34 having teeth 36. A worm gear wheel 38 having teeth 40 is coupled to a shaft 42. When the teeth 36 of the gear 34 engage the teeth 40 of the wheel 38 the gear rotates the wheel. The wheel 38 will rotate in a clockwise or counter-clockwise direction depending on the direction of rotation of the shaft 30. The shaft 42 is coupled to rotate in a support bracket 44 formed in the cabinet 26 (FIG. 3). Accordingly when the wheel 38 rotates it rotates the shaft 42 in either a clockwise or counter-clockwise direction. An actuating lever 46 is coupled to the shaft 42 adjacent an aperture 47 formed in the bracket 44. When the wheel 38 rotates the shaft 42 the shaft causes the actuating lever 46 to move up or down depending on which direction the shaft is rotated. The actuating lever 46 provides a sufficient force to overcome the pressure of the return spring (not shown) of the sustaining pedal 14 of the piano 10. An adjusting screw 48 is threadedly coupled to the end of the actuating lever 46. The adjusting screw 48 is provided to be adjusted vertically to be aligned to engage the sustaining pedal 14 of the piano. This permits the pedal activator assembly 12 to accomodate piano pedals mounted at different heights on the piano. The travel of the actuating lever 46 is limited by physical stops 50 built into the cabinet 26.

A "U" shaped bracket 52 (FIG. 4) is coupled to an intermediate portion of the actuating lever 46 by a screw or bolt 54. The bracket 52 is provided with opposed contact surfaces 56 for activating a momentary contact switch 58. Activation occurs when the contact surface 56 engages a momentary contact push button assembly 59 which is mounted adjacent the contact surface on the bracket 44 of the housing 26.

Figure 5:
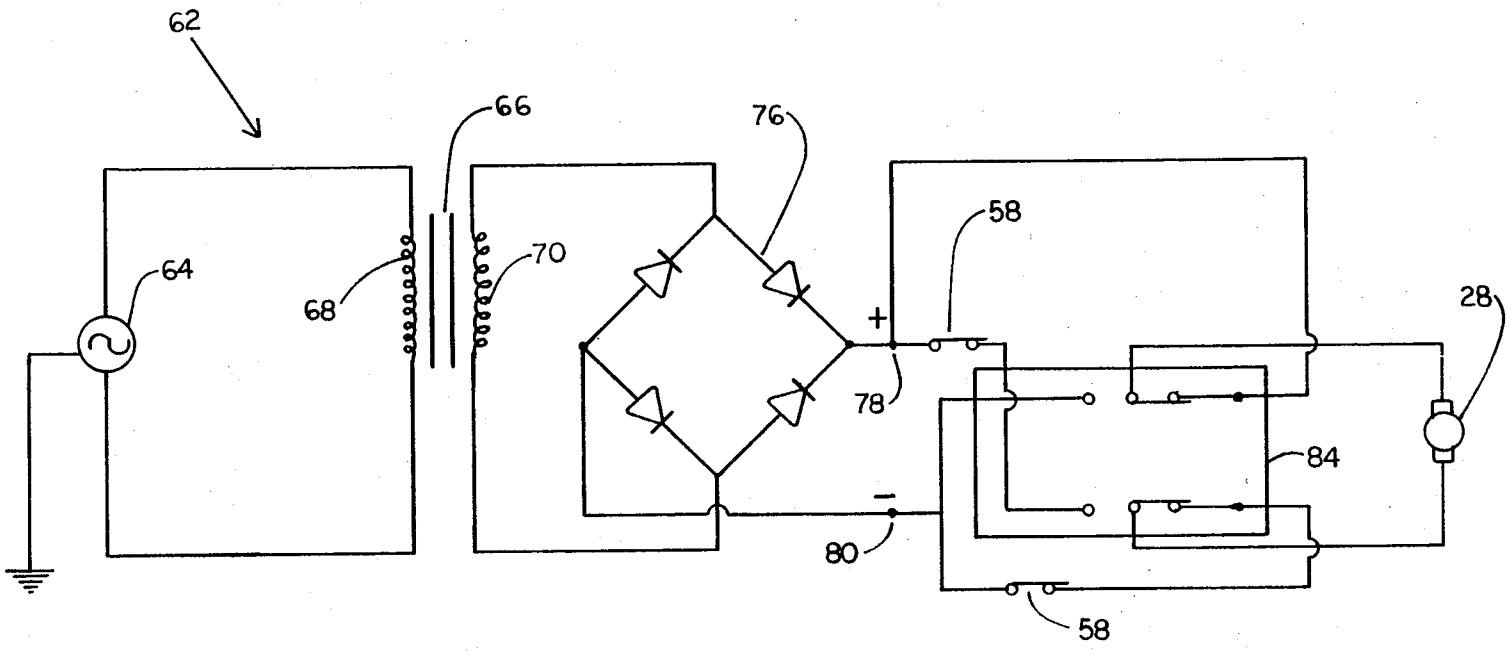
FIG. 5 is an electrical schematic of the control circuit for activating the power unit in accordance with the principles of the invention.

The power unit 24 is activated by a control circuit 62 (FIG. 5). The control circuit 62 includes a 110 volt A.

C. power source 64. The power source 64 can be obtained by pluging into any normal 110 volt wall outlet. A stepdown transformer 66 having a primary winding 68 and secondary winding 70 is coupled to the source 64 at the primary winding. The transformer 66 reduces the voltage of the source 64 at the primary winding 68 to a lower desired voltage, such as for example 12 volts A. C. at the secondary winding 70. A full wave bridge rectifier 76 is coupled to the secondary winding 70 of the transformer 66. The rectifier 76 converts the A.C. voltage at the secondary winding 70 of the transformer to a desired negative and positive D. C. voltage at outputs 78 and 80. The positive and negative voltages at outputs 78 and 80 are the voltages necessary to activate the reversible motor 28 to turn the shaft 30 in both a clockwise and counter-clockwise direction.

One of the momentary contact switches 58 is coupled to each of the outputs 78 and 80. The switches 58 are single pole single throw momentary contact switches with normally closed contacts. The contact switches 58 upon activation limit the uppermost and lower most travel of the actuating lever 46 by interrupting the flow of current when the limits of travel of the actuating lever have been reached. This occurs when the appropriate contact surface 56 of the bracket 52 engages the adjacent push button assembly 59 of the adjacent switch 58 upon movement of the actuating arm 46.

A master control switch 84 is provided to selectively provide electrical power to activate the motor 28. The master control switch 84 can be for example a double pole double throw lever actuated switch. The switch 84 may be spring return momentary contact switch having a push button assembly 86. The push button assembly 86 of the master control switch 84 is mechanically coupled to the second portion 22 of the flexible arm assembly 16 and electrically coupled into the control circuit 62 by a electrical coupling device 88 such as for example a flexible electrical cable (FIG. 1). The switch 84 requires only the application of seven grams of pressure to the push button assembly 86 to engage. This permits activation with a small movement of any part of the body, such as, for example, the head of the user as illustrated in FIG. 1. It should be understood that what ever part of the body is most convenient and capable of pressing the push button assembly 86 of the switch 84 can be used. This is accomplished simply by coupling the flexible arm 16 on the chair 18 so the push button assembly 86 is adjacent that part of the user's body.

Upon activation of the control circuit 62 the primary winding 68 of the transformer 66 is energized thus inducing the reduced voltage in the secondary winding 70 of the transformer. The voltage generated by the secondary winding 70 of the transformer 66 is then converted by the rectifier to a positive D. C. voltage at output terminal 78 and negative D. C. voltage at output terminal 80. Upon activation of the master control switch 84 a complete circuit path is established through the motor 28 from the output terminal 78. This activates the motor to rotate in a counter-clockwise direction so that the actuating lever 46 will be propelled downward from its normally up position to engage and displace the pedal 14 downardly as indicated in phantom in FIG. 4. As the actuating lever 46 reaches the end of its downward stroke the lower contact surface 56 of the "U" bracket 52 engages the adjacent push button assembly 59 of the normally closed switch 58 opening the same. This interrupts the flow of D.C. current to the motor 28 and stops the movement of the actuating lever 46. The switch 58 will remain open as long as the push button assembly 59 is engaged. The actuating lever 46 will remain locked in the down position by the worm gear assembly 32 as long as the master control switch 84 is depressed. Upon releasing the master control switch 84 a complete circuit path is established through the motor 28 from the output terminal 80. This energizes the D. C. motor 28 in the opposite direction and propels the actuating lever 46 upwardly. As the actuating lever 46 reaches the end of its upward stroke the upper contact surface 56 of the "U" bracket 52 engages the push button assembly 59 of the adjacent normally closed contact switch 58. This opens the upper switch 58 and breaks the current flow to the motor 28 thus locking the actuating lever 46 in the upper position. The switch 58 wll remain open as long as the push button assembly 59 is engaged. The actuating lever 46 will then remain locked in the up position by the worm gear assembly 32 and thus the switch 58 will remain open as long as the master control switch 84 is released.

The Piano Pedal Activator assembly 12 will enable persons with limited use of their lower limbs, or with no lower limbs at all, to remotely control the sustaining pedal 14 of a piano 10. This invention can be activated by any part of the body with a very small movement and with very little strength involved as the assembly 12 utilizes microswitches requiring only seven grams pressure to engage.

By use of a flexible arm 16 clamped to any part of a wheel chair 18, and with the control switch 84 mounted on the second portion 22 of the arm, there is no limit to the many positions that the master control switch can be placed in, thus allowing any part of the users body to be used.

Use of this device will enable handicapped persons to operate the sustaning pedal 14 of the piano 10 and play legato where it is written on the score, as opposed to being limited to playing stacatto in the entirety of the performance if the sustaining pedal cannot be used.

It should be understood that various changes and modifications can be made without departing from the spirit of the invention as defined in the following claims.

What is claimed is:

1. A pedal activator for activating a sustaining pedal of a piano including:

a motor having a shaft coupled thereto; means for actuating the motor to rotate the shaft;

a pedal actuating lever; and means for coupling the pedal actuating lever to the shaft and for moving the actuating lever into contact with the pedal so that the pedal moves from a first position down to a second position when the motor is activated to rotate the shaft in a first direction and for releasing the actuating lever from in contact with the pedal so that the pedal moves from the second, position back up to the first position when the motor is activated to rotate the shaft in second direction.

2. A pedal activator as defined in claim 1 wherein the motor actuating means includes:

first means for generating a first alternating current signal;

second means coupled to the first means for reducing the first alternating current signal and thereby produce a second alternating current signal; and third means coupled to the second means and responsive to the second alternating current signal for generating a first direct current signal to activate the motor to turn the shaft in the first direction and for generating a second direct current signal to activate the motor to turn the shaft in the second direction.

3. A pedal activator as defined in claim 2 wherein the motor activating means further includes a fourth means coupled to the third means for enabling the first direct current signal to activate the motor to turn the shaft in the first direction and for enabling the second direct current signal to activate the motor to turn the shaft in the second direction.

4. A pedal activator as defined in claim 3 wherein the motor activating means further includes a fifth means coupled between the third and fourth means for deactivating the motor when the actuating lever moves down a predetermined distance and for deactivating the motor when the actuating lever moves up a predetermined distance.

5. A pedal activator as defined in claim 4 wherein the actuating lever coupling, moving and releasing means includes:

a lever shaft coupled to the pedal actuating lever and mounted for rotating perpendicular to the motor shaft; and a gear wheel coupled to the lever shaft in engaging alignment with the gear so that when the motor shaft causes the gear to move the wheel in one direction the pedal actuating lever moves from the first position down to the second position and so that when the motor shaft causes the gear to move the wheel in the other direction the pedal actuating lever moves from the second position back up to the first position.

* * * * *